US006925763B2

(12) United States Patent
Stark et al.

(10) Patent No.: US 6,925,763 B2
(45) Date of Patent: Aug. 9, 2005

(54) APPARATUS FOR SANITARY EGRESS OF A RESTROOM

(76) Inventors: Brian J. Stark, 3424 W. Riviera Ct., Mequon, WI (US) 53092-5209; Peter J. Stark, 1530 N. Poinsettia Pl. #301, Los Angeles, CA (US) 90046-7915

( * ) Notice: Subject to any disclaimer, the term of this patent is extended or adjusted under 35 U.S.C. 154(b) by 0 days.

(21) Appl. No.: 09/886,880

(22) Filed: Jun. 20, 2001

(65) Prior Publication Data

US 2003/0110714 A1 Jun. 19, 2003

Related U.S. Application Data

(63) Continuation-in-part of application No. 09/454,802, filed on Dec. 3, 1999, now abandoned.
(60) Provisional application No. 60/111,067, filed on Dec. 4, 1998.

(51) Int. Cl.[7] ..... E04C 2/52
(52) U.S. Cl. ..... 52/220.8; 52/455; 221/34; 221/45; 221/46; 221/47; 312/187; 312/237; 312/242

(58) Field of Search ..... 52/455, 220.6, 52/220.8; 221/34, 45–47; 312/187, 237, 242

(56) References Cited

U.S. PATENT DOCUMENTS

| | | | | |
|---|---|---|---|---|
| 3,147,051 | A | 9/1964 | Birr et al. | |
| 3,222,112 | A * | 12/1965 | Bahnsen | |
| 4,408,811 | A | 10/1983 | Richardson et al. | |
| 6,237,805 | B1 * | 5/2001 | Katsanevas | 221/45 |

* cited by examiner

*Primary Examiner*—Carl D Friedman
*Assistant Examiner*—Yvonne M. Horton
(74) *Attorney, Agent, or Firm*—Michael Best & Friedrich LLP

(57) ABSTRACT

Apparatus for permitting sanitary egress from a restroom having a wall, a doorway in the wall and a door in the doorway, the apparatus including a dispenser assembly adapted to contain and dispense a supply of sheets to a user prior to exiting the restroom and a disposal container assembly adapted to receive the supply of sheets upon exiting the restroom and located adjacent the doorway.

5 Claims, 3 Drawing Sheets

304

334
326
360
346
334
322
326
338
342
332
330
350
314
318
310

314
326
370
310

APPARATUS FOR SANITARY EGRESS OF A RESTROOM

RELATED APPLICATIONS

This application is a continuation in part of co-pending application Ser. No. 09/454,802 filed Dec. 3, 1999 which claimed the benefit of the earlier filing date of provisional application Ser. No. 60/111,067 filed Dec. 4, 1998, now abandoned.

BACKGROUND OF THE INVENTION

1. Technical Field

The invention relates generally to apparatus for preventing the transmission of infectious agents, and more particularly to sanitary shields for preventing the transmission of infectious agents between users of public facilities.

2. Background Information

The public consciousness of infectious disease is at historically high levels. Many individuals will go to extremes to avoid physical contact with any "public surface." Such "public surfaces" would include exposed surfaces in public rest rooms, door knobs, and public telephone handsets.

Particularly for the business traveler who is both germ-conscious and who must routinely use public restrooms immediately after use by others, such as at crowded airports, train and bus stations, using public restrooms can be a source of daily discomfort and concern. Other public venues, such as restaurants, athletic events, etc., also often entail relatively large groups of people using the publicly available facilities.

It is a problem when using restrooms that communicable and/or contagious diseases of a previous user may be spread to subsequent users of the restroom through contact with the various surfaces of the restroom. Of course, many efforts have been made in making toilets and urinals more sanitary, and every public restroom includes washing facilities. However, when a large number of people use a restroom, the probability of infectious agents being transmitted nonetheless increases. Also, even though a person may thoroughly wash his or her hands before leaving the restroom, most public restrooms have doors which require opening by hand, thus immediately exposing freshly washed hands to another, possibly infectious, public surface on the door knob, handle or push plate on the door.

Thus, door handles in public restrooms in particular are handled by a multitude of people each and every day. In the likely event that at least one of this multitude of people is sick with a communicable disease, every subsequent user is subject to infection by whatever germs or pathogenic microorganisms might be able to sustain themselves on the door components until being passed on. Moreover, other than germs, door handles which are handled by large numbers of people may from time to time accumulate other undesirable substances thereon, e.g., greases, saliva or other bodily fluids, containing potentially infectious diseases.

From a public health standpoint, it is clearly desirable to contain the spread of contagious and communicable diseases.

SUMMARY OF THE INVENTION

The invention relates to a device for protecting an individual using a restroom from becoming infected by germs or pathogenic bacteria present on the public surfaces of the restroom, in particular, surfaces on the door. It is an object of the present invention to provide a novel restroom door handle sanitary shroud. It is another object of the present invention to provide a system for providing a restroom door handle sanitary shroud and for providing a ready means of disposal of the shroud. A further object of this invention is to provide a simple, inexpensive and disposable sterile object with which to grasp a restroom door handle or knob. A still further object of this invention is to provide a sterile sheet that can be selectively impregnated with a variety of germicidal agents and readily available upon exiting a restroom. Another object of the invention is to provide a sterile door handle shroud that is easily dispensed on a wall adjacent the restroom door, that is simple and inexpensive to replace, and that is easily disposed of.

These and other objects are accomplished by this invention generally speaking by providing apparatus for permitting sanitary egress from a restroom. In one embodiment, the apparatus includes a dispenser adapted to be mounted of a wall of the restroom adjacent a door, the dispenser being further adapted to contain and dispense a supply of sheets to a user prior to exiting the restroom. The apparatus further includes a disposal container assembly adapted to be mounted on the opposite side of the wall of the restroom immediately adjacent the door, the disposal container assembly being adapted to receive the supply of sheets upon exiting the restroom.

In one embodiment, the invention provides a protective system including a dispenser mounted on the door itself in a location affording easy access to a protective sheet. The system also includes a disposal container assembly mounted on the door, also affording a ready means of disposal of the sheet. The dispenser can be mounted on the same side of the door as the dispenser, an advantageous arrangement for "push" doors, or alternatively on the side of the door opposite the dispenser for "pull" doors.

In another embodiment, the invention provides an apparatus for permitting sanitary egress from a restroom, the restroom including a door having opposite sides. The apparatus includes a dispenser mounted on one of the sides of the door, the dispenser being adapted to contain and dispense a supply of sheets to a user prior to exiting the restroom. The apparatus also includes a disposal container assembly mounted on the door and is adapted to receive the supply of sheets upon exiting the restroom.

In another embodiment, the invention provides apparatus for permitting sanitary egress from a restroom, the apparatus including a mounting member having opposite sides and a passage communicating between the opposite sides of the mounting member. The apparatus also includes a dispenser assembly mounted on the mounting member and including a first housing portion adapted to contain and dispense a supply of sheets, and a disposal assembly mounted on the mounting member and including a second housing portion defining a container chamber having a portion extending into the passage.

In another embodiment, the invention provides apparatus for permitting sanitary egress from a room having an exit and a mounting member having opposite sides and being located near the exit, the mounting member having extending there through a passage. The apparatus includes a housing adapted to be mounted on the mounting member, the housing defining an interior space and having a portion extending into the passage in the mounting member, a first opening in the housing, a second opening in the housing, and a member located in the interior space and dividing the interior space into a dispenser portion communicating with the first opening and adapted to contain a supply of sheets and into a container portion communicating with the second opening and adapted to receive the supply of sheets.

Various known germicides, bactericides, fungicides or other disinfectants may be used to impregnate the supply of sheets dispensed to users of the restroom equipped with the invention. The term "germicide" used throughout this disclosure and the claims is intended to include all types of germicides, fungicides, bactericides, and other agents to control undesirable microorganisms. Also, antimicrobial materials can easily be impregnated in the sheets or shrouds that are a part of the present invention.

Figure 1:
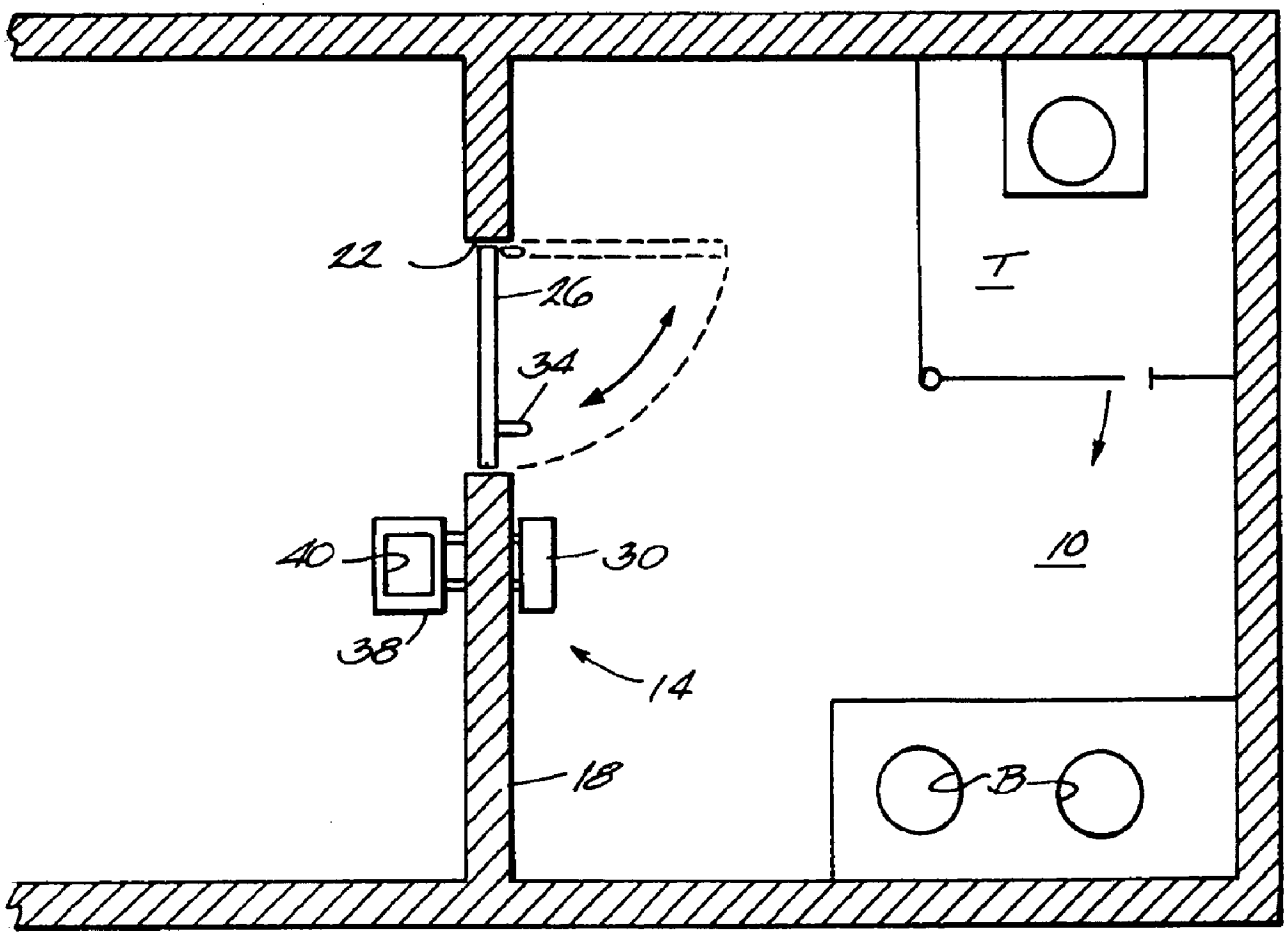
FIG. 1 is an plan view of a public restroom equipped with a protective system embodying the invention.

Before a specific embodiment of the invention is shown in detail, it should be well understood that various other embodiments and arrangements of components are available for carrying out the invention. For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DETAILED DESCRIPTION OF THE PREFERRED EMBODIMENT

The drawings illustrate protective systems which embody the invention. Referring first to FIG. 1, there is shown a restroom 10 of conventional design with the exception that the restroom 10 has been modified to include an apparatus or system 14 for permitting sanitary egress from the restroom 10. In particular, the restroom includes a wall 18, a doorway 22 in the wall 18, and a door 26 hung in the doorway 22. The restroom also includes a pair of basins B and a toilet stall T. As described with particularity below, the system 14 can be mounted on a wall 18 or door 26, and such structures are referred to herein as mounting members.

The system 14 includes a sheet dispenser assembly 30 adapted to be mounted on the wall 18, preferably adjacent the doorway 22. As will be readily understood, however, the dispenser assembly 30 can be placed adjacent any public surface in the restroom 10, including on the door 26 in the manner discussed below. Though not shown in the drawings, the dispenser assembly 30 is adapted to contain and dispense a supply of sanitized sheets S to a user prior to the user's exiting the restroom 10 via the doorway 22. Many designs for the dispenser assembly 30 can be successfully used, and are contemplated and included within the present invention for issuing the supply of sanitized tissues. The dispenser assembly 30 could include either a roll of sanitized sheets or shrouds or, in the alternative, a stack of individual sanitized tissues. In an alternative embodiment of the dispenser assembly 30, the dispensing of sheets from the dispenser assembly 30 could be conditioned upon the user's depositing a coin or token into the dispenser assembly 30.

Upon approaching the doorway 22 from the interior of the restroom 10, a user obtains a single sheet from the dispenser unit 30. The sheet is readily dispensed in a manner afford easy use of the tissue to grasp a handle or door knob 34 on the door 26 to open the door 26 and pass through the door way 22. Similarly, the sheet may be used merely to protect the user's hand when pushing the door 26 open, if the door 26 is merely a swinging type of door. The user's hand is thus protected from any contagion that may be present on the public surfaces provided by the door 26.

The system 14 also includes a disposal container assembly 38 adapted to be mounted on the wall 18 of the restroom 10 adjacent the doorway 26. In FIG. 1, the dispenser is mounted on the wall 18 outside the restroom 10 and immediately adjacent the doorway 22. Alternatively, the disposal container assembly 38 could be mounted on the wall 18 on the interior of the restroom 10 and adjacent the doorway 22. Also, as discussed below, the disposal container assembly 38 can be mounted on the door 26 itself, either on the exterior or interior of the restroom 10.

The disposal container assembly 38 includes an opening 40 communicating with the interior of the unit 38 and is adapted to receive the supply of sheets upon the user's exiting the restroom 10. Again, many designs for the disposal container assembly 38 can be successfully used, and are contemplated to be included within the present invention for receiving the supply of tissues after the user has used the tissue to assist in the sanitary exit of the restroom 10 through the doorway 22.

Figure 2:
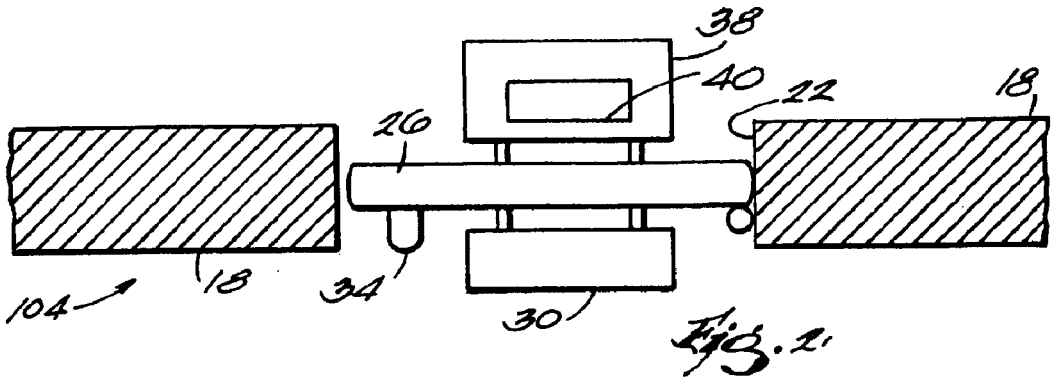
FIG. 2 is a plan view similar to FIG. 1 illustrating a protective system that is an alternative embodiment of the invention.

Referring now particularly to FIG. 2, FIG. 2 illustrates a system 104 which is an alternative embodiment of the system 14. The system 104 is similar to system 14 in that system 104 includes the same components as system 14. Accordingly, common reference numerals are used to identify common components. However, as explained below, the system 104 provides a different arrangement of components.

More particularly, FIG. 2 illustrates the door 26 as a "pull" door which opens into the interior of the restroom 10. The system 104 includes a sheet dispenser assembly 30 mounted on the door 26 in the interior of the restroom 10. Upon approaching the doorway 22 from the interior of the restroom 10, a user obtains a single sheet from the dispenser unit 30. The sheet is readily dispensed in a manner afford easy use of the tissue to grasp a handle or door knob 34 on the door 26 to open the door 26 and pass through the door way 22. The user's hand is thus protected from any contagion that may be present on the public surfaces provided by the door 26. The system 104 also includes a disposal container assembly 38 mounted on the opposite, exterior side of the door 26 for disposal of sheets and the like by users of the system 104 exiting the restroom 10.

Figure 3:
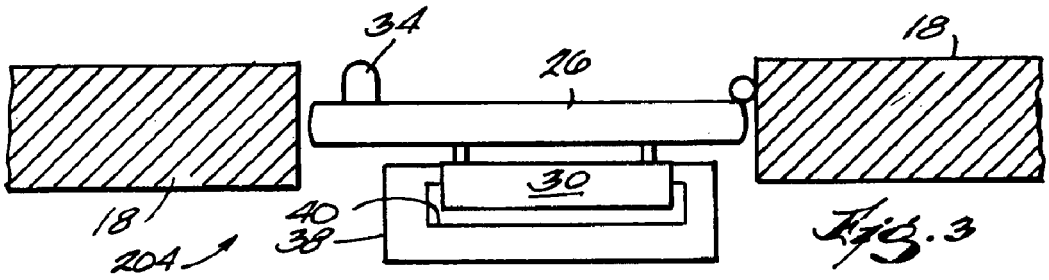
FIG. 3 is a plan view similar to FIG. 1 illustrating a protective system that is another alternative embodiment of the invention.
Figure 4:
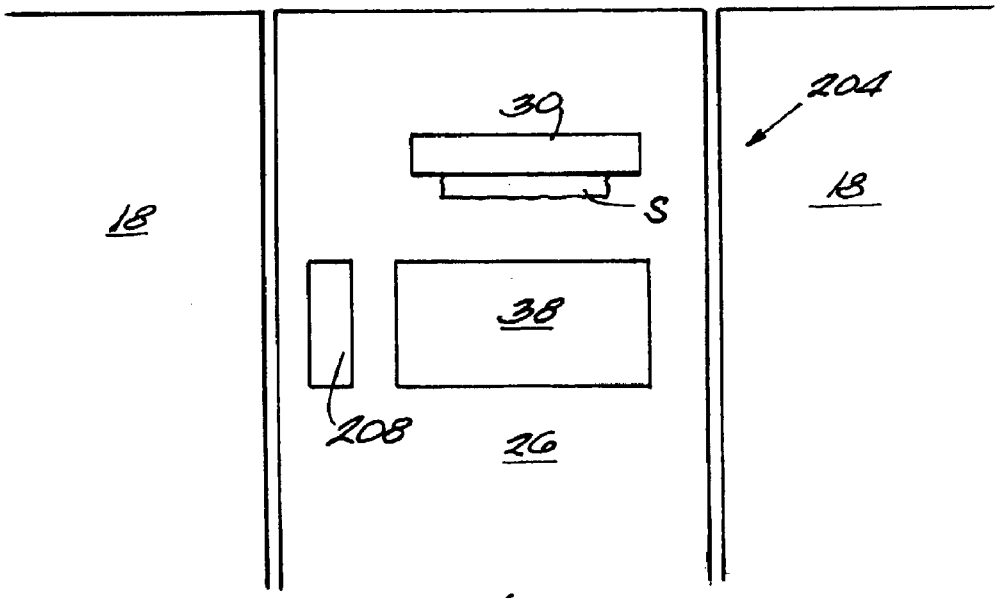
FIG. 4 is an elevational view of the system shown in FIG. 3.

Referring now particularly to FIGS. 3 and 4, FIGS. 3 and 4 illustrate a system 204 which is an alternative embodiment of the system 14. The system 104 is similar to system 14 in that system 204 includes the same components as system 14. Accordingly, common reference numerals are used to identify common components. However, as explained below, the system 204 provides a different arrangement of components.

More particularly, FIGS. 3 and 4 illustrate the door 26 as a "push" door which includes a push plate 208 on the interior side of the door 26 and which is hung in the doorway 22 so as to open into the exterior of the restroom 10. The system 204 includes a sheet dispenser assembly 30 mounted on the side of the door 26 facing the interior of the restroom 10. Upon approaching the doorway 22 from the interior of the restroom 10, a user obtains a single sheet from the dispenser unit 30 prior to contacting the push plate 208 to open the door 26 and pass through the door way 22. The user's hand is thus protected from any contagion that may be present on the public surfaces provided by the door 26. The system 204 also includes a disposal container assembly 38 mounted on the same side of the door 26 as the dispenser assembly 30, i.e., on the side of the door facing the interior of the restroom 10, in a location immediately below the dispenser assembly 30. The opening of the dispenser assembly 30 is thus situated in a position to accept sheets used by the user of system 204.

Figures 5, 6, 7:
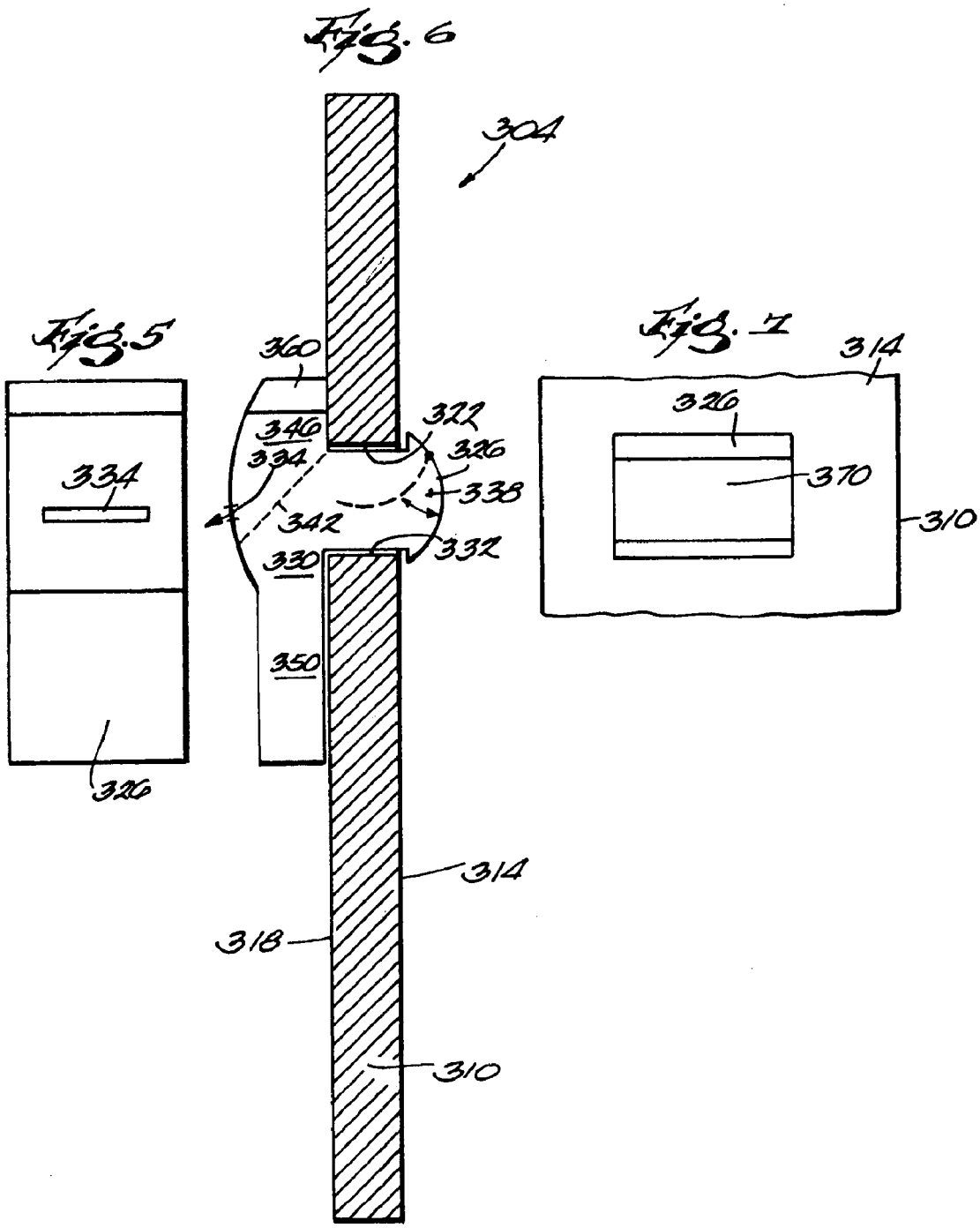
FIG. 5 is a front elevational view of a protective system that is anther alternative embodiment of the invention.
FIG. 6 is a cross-sectional view of the system shown in FIG. 5.
FIG. 7 is a view taken along line 7—7 in FIG. 6.

Referring now particularly to FIGS. 5–7, FIGS. 5–7 illustrate a system 304 which is an alternative embodiment of the system 14. The system 304 is similar to system 14 in that system 304 includes the same components as system 14. Accordingly, common reference numerals are used to identify common components. However, as explained below, the system 304 provides a different arrangement of components.

More particularly, FIGS. 5–7 illustrate the mounting member 310, such as a door or wall adjacent an exit/doorway, as having opposite sides 314, 318 and a passage 322 extending between the opposite sides 314, 318. The system 304 also includes a housing 326 defining an interior chamber or space 330. As best shown in FIG. 6, a portion 332 of the housing 326 extends into the passage in the mounting member. The housing 326 includes a first opening 334 communicating with the interior space, and a second opening 338 which also communicates with the interior chamber.

The housing 326 also includes a partition member 342 located in the interior space 330 and dividing the interior space 330 into a dispenser portion 346 communicating with the first opening 334 and adapted to contain a supply of sheets (not shown in FIG. 6). The sheets are dispensed by way of the first opening 334. The partition 342 also divides the interior space 330 into a container portion 350 communicating with the second opening 338 and adapted to receive the supply of sheets. In the embodiment shown in FIGS. 5–7, the second opening 338 in the housing 326 is located on the side 314 of the mounting member 310 opposite the side 318 on which the housing 326 is mounted by virtue of the portion 332 of the housing 326 that extends through the passage 322 in the mounting member 310. The housing 326 also includes a cover 360 which overlies the upper portion of the housing 326. The cover 360 is removable so as to afford selective access to the interior 346 of the dispenser portion. The housing 326 also includes a door 370 overlying the second opening 338 and affording access to the disposal portion 350 of the housing 326 by way of the second opening 338 and the passage through the mounting member 322.

Thus, the system 304 provides a sheet dispenser assembly 30 mounted on the side of the mounting member. Upon approaching the system 304, a user obtains a single sheet from the dispenser assembly 30. The system 304 thus also includes provides a disposal assembly 38 mounted on the same side of the door 26 as the dispenser assembly 30. The system 304, when assembled, is formed as a singular unit, but may be assembled of components to facilitate mounting the system on the mounting member.

Many variations are contemplated and included in the present invention. For example, the dispenser assembly 30 is shown as mounted adjacent the main doorway 22 into and out of the restroom 10. However, it is to be understood that the sheet dispenser assembly 30 may be mounted in other areas of the restroom, e.g., on toilet stall doors, where the provision of a supply of sanitized tissues may be helpful in preventing the spread of contagion.

While the systems 14, 104, 204 and 304 described and illustrated above are situated in the environment of a restroom, it will be readily appreciated that the systems 14, 104 and 204 can be applied successfully and usefully in any number of environments. Such other environments include telephone booths, food service areas, such as salad bars, buffets and the like, and any other environment wherein public surfaces are present.

The sanitized shroud or sheet is disposable and is used only a single time. The tissue could be readily is moisturized and/or provided with a disinfectant as well as a deodorizer providing for a germ-free and scented shroud as the tissue is used to grasp and/or open the door.

It will be obvious from the above description that the present invention provides a new and improved sanitized tissue for use to exit a public restroom. It will be further obvious from the above description that the present invention provides a combined sheet dispenser and disposal system.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

Various other features and advantages are set forth in the following claims:

We claim:

1. Apparatus for permitting sanitary egress from a restroom, said apparatus comprising:

a mounting member including opposite sides and a passage communicating between the opposite sides of the mounting member, a dispenser assembly mounted on the mounting member and including a first housing portion adapted to contain and dispense a supply of sheets, and a disposal assembly mounted on the mounting member and including a second housing portion defining a container chamber having a portion extending into the passage, wherein the dispenser assembly and the disposal assembly are on the same side of the mounting member, and wherein the first housing portion includes a first opening located on one side of the mounting member, and wherein the second housing portion includes a second opening located on the side of the mounting member opposite the first opening.

2. Apparatus as set forth in claim 1 wherein the first housing portion includes a removable top.

3. Apparatus for permitting sanitary egress from a room having an exit and a mounting member having opposite sides and being located near the exit, the mounting member having extending there through a passage, said apparatus comprising;

a housing adapted to be mounted on the mounting member, the housing defining an interior space and having a portion extending into the passage in the mounting member, a first opening in the housing, a second opening in the housing, and a member located in the interior space and dividing the interior space into a dispenser portion communicating with the first opening and adapted to contain a supply of sheets and into a container portion communicating with the second opening and adapted to receive the supply of sheets.

4. Apparatus as set forth in claim 3 wherein the first opening is on the one side of the opposite sides of the mounting member and the second opening is located on the side of the mounting member opposite the first opening.

5. Apparatus as set forth in claim 3 wherein the portion of the housing extending into the passage includes said second opening.

* * * * *